US005728182A

United States Patent [19]

Cherpeck

[11] Patent Number: 5,728,182

[45] Date of Patent: Mar. 17, 1998

[54] POLYALKYL ESTERS OF SUBSTITUTED POLYPHENYL ETHERS AND FUEL COMPOSITIONS CONTAINING THE SAME

[75] Inventor: Richard E. Cherpeck, Cotati, Calif.

[73] Assignee: Chevron Chemical Company, San Ramon, Calif.

[21] Appl. No.: 778,200

[22] Filed: Dec. 30, 1996

[51] Int. Cl.[6] ..... C10L 1/22

[52] U.S. Cl. ..... 44/384; 44/399; 560/129; 560/155; 560/156; 560/189

[58] Field of Search ..... 508/384, 399; 560/129, 155, 156, 189

[56] References Cited

U.S. PATENT DOCUMENTS

| | | | |
|---|---|---|---|
| 3,285,855 | 11/1966 | Dexter et al. | 252/57 |
| 4,859,210 | 8/1989 | Franz et al. | 44/53 |
| 5,196,142 | 3/1993 | Mollet et al. | 252/311 |
| 5,196,565 | 3/1993 | Ross | 560/55 |
| 5,380,345 | 1/1995 | Cherpeck | 44/399 |
| 5,441,544 | 8/1995 | Cherpeck | 44/384 |
| 5,538,521 | 7/1996 | Cherpeck | 44/384 |
| 5,540,743 | 7/1996 | Cherpeck | 44/399 |
| 5,637,119 | 6/1997 | Cherpeck | 44/384 |

*Primary Examiner*—Margaret Medley
*Attorney, Agent, or Firm*—Claude J. Caroli

[57] ABSTRACT

A polyalkyl ester of a substituted polyphenylether having the formula:

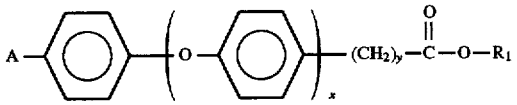

wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms; $R_1$ a polyalkyl group having an average molecular weight in the range of about 450 to about 5000; and x is an integer from about 1 to about 10 and y is an integer from 0 to about 10. The polyalkyl esters of the substituted polyphenyl ethers of the present invention are useful as fuel additives for the prevention and control of engine deposits.

33 Claims, No Drawings

POLYALKYL ESTERS OF SUBSTITUTED POLYPHENYL ETHERS AND FUEL COMPOSITIONS CONTAINING THE SAME

BACKGROUND OF THE INVENTION

1. Field of the Invention

This invention relates to polyalkyl esters of substituted polyphenyl ethers and to fuel compositions containing polyalkyl esters of substituted polyphenyl ethers to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable derivability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

U.S. Pat. No. 5,380,345, issued Jan. 10, 1995 to Cherpeck, discloses polyalkyl nitro and amino aromatic esters that provide excellent control of engine deposits, especially intake valve deposits, when employed as fuel additives in fuel compositions.

U.S. Pat. No. 5,540,743, issued Jul. 30, 1996 to Cherpeck, relates to polyalkyl and poly(oxyalkylene)benzyl amine esters and to fuel compositions containing the same. More particularly, this patent discloses that certain polyalkyl and poly(oxyalkylene)benzyl amine esters are useful in fuel compositions to prevent and control engine deposits, especially intake valve deposits.

My commonly assigned copending U.S. patent application Ser. No. 08/581,658, filed Dec. 29, 1995, discloses a novel fuel-soluble substituted aromatic polyalkyl ether fuel additive which is useful for the prevention and control of engine deposits, particularly intake valve deposits, when employed as fuel additives in fuel compositions.

U.S. Pat. No. 4,859,210, issued Aug. 22, 1989 to Franz et al., discloses fuel compositions containing (1) one or more polybutyl or polyisobutyl alcohols wherein the polybutyl or polyisobutyl group has a number average molecular weight of 324 to 3,000, or (2) a poly(alkoxylate) of the polybutyl or polyisobutyl alcohol, or (3) a carboxylate ester of the polybutyl or polyisobutyl alcohol. This patent further teaches that when the fuel composition contains an ester of a polybutyl or polyisobutyl alcohol, the ester-forming acid group may be derived from saturated or unsaturated, aliphatic or aromatic, acyclic or cyclic mono- or polycarboxylic acids.

U.S. Pat. No. 3,285,855, issued Nov. 15, 1966 to Dexter et al., discloses alkyl esters of dialkyl hydroxybenzoic and hydroxyphenylalkanoic acids wherein the ester moiety contains from 6 to 30 carbon atoms. This patent teaches that such esters are useful for stabilizing polypropylene and other organic material normally subject to oxidative deterioration. Similar alkyl esters containing hindered dialkyl hydroxyphenyl groups are disclosed in U.S. Pat. No. 5,196,565, which issued Mar. 23, 1993 to Ross.

U.S. Pat. No. 5,196,142, issued Mar. 23, 1993 to Mollet et al., discloses alkyl esters of hydroxyphenyl carboxylic acids wherein the ester moiety may contain up to 23 carbon atoms. This patent teaches that such compounds are useful as antioxidants for stabilizing emulsion-polymerized polymers.

It has now been discovered that certain polyalkyl esters of substituted polyphenyl ethers are surprisingly useful for reducing engine deposits, especially intake valve deposits, when employed as fuel additives in fuel compositions.

SUMMARY OF THE INVENTION

The present invention provides novel fuel-soluble polyalkyl esters of substituted polyphenylether fuel additives which are useful for the prevention and control of engine deposits, particularly intake valve deposits.

The fuel-soluble polyalkyl esters of the substituted polyphenyl ethers of the present invention have the formula:

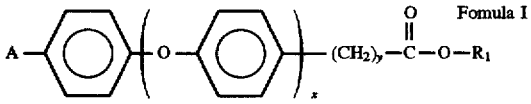

Fomula I wherein A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms; $R_1$ is a polyalkyl group having an average molecular weight in the range of about 450 to about 5000.

x is an integer from about 1 to about 10 and y is an integer from 0 to about 10.

The present invention further provides a fuel composition comprising a major amount of hydrocarbons boiling in the gasoline or diesel range and an effective deposit-controlling amount of a polyalkyl ester of a substituted polyphenylether.

The present invention further provides a fuel concentrate comprising an inert stable oleophilic organic solvent boiling in the range of from about 150° F. (65° C.) to about 400° F. (205° C.) and from about 10 to about 70 weight percent of a polyalkyl ester of a substituted polyphenylether of formula I above.

The present invention also provides a method for reducing engine deposits in an internal combustion engine comprising operating the engine with a fuel composition containing an effective deposit-controlling amount of a polyalkyl ester of a substituted polyphenylether of formula I above.

Among other factors, the present invention is based on the surprising discovery that certain polyalkyl esters of substituted polyphenyl ethers provide excellent control of engine deposits, especially on intake valves, when employed as fuel additives in fuel compositions.

DETAILED DESCRIPTION OF THE INVENTION

The fuel-soluble polyalkyl esters of the substituted polyphenyl ethers of the present invention have the general formula:

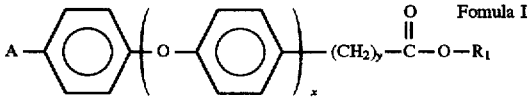

Fomula I wherein A, $R_1$, x, and y are as defined above.

In formula I, A is preferably an amino or aminomethyl group. Most preferably, A is an amino group.

Preferably, $R_1$ is a polyalkyl group having an average molecular weight in the range of about 500 to about 5000, more preferably about 500 to about 3000, and most preferably about 500 to about 2000.

In general, x is an integer from about 1 to about 10. Preferably, x is about 1. Generally, y is an integer from 0 to about 10. Preferably, y is 0.

When A is an N-alkylamino group, the alkyl group of the N-alkylamino moiety preferably contains about 1 to about 4 carbon atoms. More preferably, the alkyl group is methyl or ethyl. For example, particularly preferred N-alkylamino groups are N-methylamino and N-ethylamino groups.

Similarly, when A is an N,N-dialkylamino group, each alkyl group of the N,N-dialkylamino moiety preferably contains about 1 to about 4 carbon atoms. More preferably, each alkyl group is either methyl or ethyl. For example, particularly preferred N,N-dialkylamino groups are N,N-dimethylamino, N-ethyl-N-methylamino and N,N-diethylamino groups.

A preferred group of polyalkyl esters of the substituted polyphenyl ethers for use in this invention are compounds of formula I wherein A is amino or aminomethyl; $R_1$ is a polyalkyl group having an average molecular weight in the range of about 450 to about 5000; x is about 1 and y is 0.

A more preferred group of polyalkyl esters of the substituted polyphenyl ethers are those of formula I wherein A is amino; $R_1$ is a polyalkyl group having an average molecular weight in the range of about 450 to about 5000; x is about 1 and y is 0.

It is especially preferred that the amino, aminomethyl, cyano, nitro, N-alkylamino or N-alkylaminomethyl, N,N-dialkylamino or N,N-dialkylaminomethyl substituent, present in the aromatic moiety of the polyalkyl esters of the substituted polyphenyl ethers of this invention be situated in a meta or para position relative to the polyphenylether moiety.

The polyalkyl esters of the substituted polyphenyl ethers employed in the present invention will generally have a sufficient molecular weight so as to be non-volatile at normal engine intake valve operating temperatures (about 200° C. to about 250° C.). Typically, the molecular weight of the polyalkyl esters of the substituted polyphenyl ethers will range from about 600 to about 6000, preferably from about 600 to about 3000, more preferably from 700 to 2000.

Fuel-soluble salts of the polyalkyl esters of the substituted polyphenyl ethers in the present invention can be readily prepared for those compounds containing an amino, N-alkylamino or N-alkylaminomethyl or N,N-dialkylamino or N,N-dialkylaminomethyl group and such salts are contemplated to be useful for preventing or controlling engine deposits. Suitable salts include, for example, those obtained by protonating the amino moiety with a strong organic acid, such as an alkyl- or arylsulfonic acid. Preferred salts are derived from toluenesulfonic acid and methanesulfonic acid.

Definitions

As used herein, the following terms have the following meanings unless expressly stated to the contrary.

The term "amino" refers to the group: $—NH_2$.

The term "aminomethyl" refers to the group: $—CH_2NH_2$.

The term "cyano" refers to the group: —CN.

The term "nitro" refers to the group: $—NO_2$.

The term "N-alkylamino" refers to the group: $—NHR_a$, wherein $R_a$ is an alkyl group. The term "N,N-dialkylamino" refers to the group: $—NR_bR_c$, wherein $R_b$ and $R_c$ are alkyl groups.

The term "N-alkylaminomethyl" refers to the group: $—CH_2NHR_d$, wherein $R_d$ is an alkyl group. The term "N,N-dialkylaminomethyl" refers to the group: $—CH_2NR_eR_f$, wherein $R_e$ and $R_f$ are alkyl groups.

The term "alkyl" refers to both straight- and branched-chain alkyl groups.

The term "lower alkyl" refers to alkyl groups having about 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "lower alkoxy" refers to the group $—OR_g$ wherein $R_g$ is lower alkyl. Typical lower alkoxy groups include methoxy, ethoxy, and the like.

The term "polyalkyl" refers to an alkyl group which is generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene, and 1-decene. Polyolefins prepared from such mono-olefins include polypropylene, polybutene, especially polyisobutene, and the polyalphaolefins produced from 1-octene and 1-decene.

General Synthetic Procedures

The polyalkyl esters of the substituted polyphenyl ethers in this invention can be prepared by the following general methods and procedures. Those skilled in the art will recognize that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but one skilled in the art will be able to determine such conditions by routine optimization procedures.

Moreover, those skilled in the art will recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis*, Second Edition, Wiley, New York, 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the polyalkyl esters of the substituted polyphenyl ethers of this invention having an amino group on the aromatic moiety will generally be prepared from the corresponding nitro derivative. Accordingly, in many of the following procedures, a nitro group will serve as a protecting group for the amino moiety. Moreover, the compounds of this invention having a $—CH_2NH_2$ group on the aromatic moiety will generally be prepared from the corresponding cyano derivative, —CN. Thus, in many of the following procedures, a cyano group will serve as a protecting group for the $—CH_2NH_2$ moiety.

The polyalkyl esters of the substituted polyphenyl ethers of the present invention wherein x is 1 may be prepared by first esterifying an aromatic carboxylic acid having the formula:

Fomula II

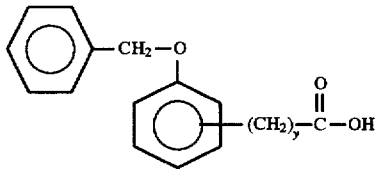

with a polyalkyl alcohol having the formula:

$R_1$—OH Formula III wherein $R_1$ is as defined above, using conventional esterification reaction conditions.

The aromatic carboxylic acids of formula II employed in the above-described procedures are either known compounds or can be prepared from known compounds by conventional procedures. Representative aromatic carboxylic acids suitable for use in these reactions include, for example, 3-benzyloxybenzoic acid and 4-benzyloxybenzoic acid. 4-Benzyloxybenzoic acid is preferred.

The polyalkyl alcohols of formula III may also be prepared by conventional procedures known in the art. Such procedures are taught, for example, in U.S. Pat. Nos. 5,055,607 to Buckley and 4,859,210 to Franz et al., the disclosures of which are incorporated herein by reference.

In general, the polyalkyl substituent on the polyalkyl alcohols of formula III and the resulting polyalkyl aromatic esters of the present invention will have an average molecular weight in the range of about 450 to about 5000, preferably about 500 to about 5000, more preferably about 500 to about 3000, and most preferably about 500 to about 2000.

The polyalkyl substituent on the polyalkyl alcohols employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene, and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl alcohols are polyisobutenes which comprise at least about 20% of the more reactive methylvinylidene isomer, preferably at least about 50%, and more preferably at least about 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain.

Examples of suitable polyisobutenes having a high alkylvinylidene content include Ultravis 30, a polyisobutene having a molecular weight of about 1300 and a methylvinylidene content of about 74%, and Ultravis 10, a polyisobutene having a molecular weight of about 950 and a methylvinylidene content of about 76%, both available from British Petroleum.

The polyalkyl alcohols may be prepared from the corresponding olefins by conventional procedures. Such procedures include hydration of the double bond to give an alcohol. Suitable procedures for preparing such long-chain alcohols are described in I. T. Harrison and S. Harrison, *Compendium of Organic Synthetic Methods,* Wiley-Interscience, New York (1971), pp. 119–122, as well as in U.S. Pat. Nos. 5,055,607 and 4,859,210.

As indicated above, the polyalkyl aromatic esters of formula I may be prepared by esterifying an aromatic carboxylic acid of formula II with a polyalkyl alcohol of formula III under conventional esterification reaction conditions.

Typically, this reaction will be conducted by contacting a polyalkyl alcohol of formula III with about 0.25 to about 1.5 molar equivalents of an aromatic carboxylic acid of formula II in the presence of an acidic catalyst at a temperature in the range of about 70° C. to about 160° C. for about 0.5 to about 48 hours. Suitable acid catalysts for this reaction include p-toluenesulfonic acid, methanesulfonic acid, and the like. The reaction may be conducted in the presence or absence of an inert solvent, such as benzene, toluene, and the like. The water generated by this reaction is preferably removed during the course of the reaction by, for example, azeotropic distillation with an inert solvent, such as toluene.

Alternatively, the polyalkyl aromatic esters of formula I may be prepared by reacting a polyalkyl alcohol of formula III with an acid halide derived from an aromatic carboxylic acid of formula II, such as an acid bromide or acid chloride.

Generally, the carboxylic acid moiety of formula II may be converted into an acyl halide moiety by contacting a compound of formula II with an inorganic acid halide, such as thionyl chloride, phosphorous trichloride, phosphorous tribromide, or phosphorous pentachloride; or with oxalyl chloride. Typically, this reaction will be conducted using about 1 to about 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction.

Reaction of the acid halide derived from formula II with a polyalkyl alcohol of formula III and subsequent removal of the benzyl moiety provides a polyalkyl aromatic ester having the formula IV below:

Fomula IV

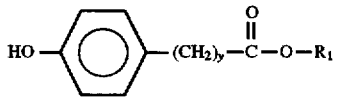

wherein $R_1$ and y are as defined above.

Typically, this reaction is conducted by contacting a compound of formula III with about 0.9 to about 1.5 molar equivalents of the acid halide in an inert solvent, such as toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as triethylamine, di(isopropyl)ethylamine, pyridine or 4-dimethylaminopyridine. Catalyst such as scandium trifluoromethane sulfonate or tributylphosphine may also be used to facilitate the esterification reaction. Cleavage of the benzyl ether using conventional hydrogenolysis procedures then provides compounds of the above formula IV. For example, benzyl protecting groups may be removed by hydrogenolysis under about 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from 0° C. to about 40° C. for about 1 to about 24 hours.

Where x is about 2 to about 10, the structure of formula IV may be further reacted with a suitable amount of a protected hydroxyaromatic halide having the formula:

Formula V

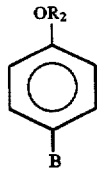

wherein B is a halide, such as chloride or bromide, and $R_2$ is a suitable hydroxy protecting group, such as benzyl, utilizing the Ullmann ether condensation, to give an aromatic ester having the formula:

Formula VI

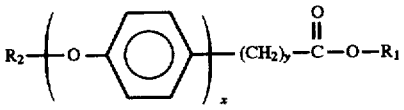

wherein $R_1$, $R_2$, X, and y are defined as above.

Finally, the polyalkyl esters of the substituted polyphenyl ethers of the present invention may be prepared by reacting a compound of formula VI above, after deprotecting the hydroxy group, with an aromatic compound having the formula:

Formula VII

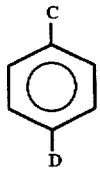

wherein C is a halide, preferably a chloride or fluoride, and more preferably fluoride, and D is cyano or nitro. Such aromatic compounds of formula VII are well known to one skilled in the art to be readily available commercially. For example, these compounds can be purchased from Aldrich Chemical Company, Inc. The reaction of the hydroxy compound of formula VI with the cyano or nitro aromatic halide of formula VII provides the polyalkyl esters of the substituted polyphenylethers of formula VIII.

Formula VIII

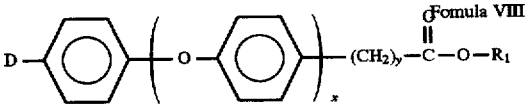

wherein $R_1$, D, x, and y are defined as above.

Alternatively, compounds of the present invention can be prepared by esterifying a compound of formula IX below:

Formula IX

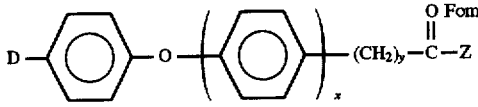

wherein D, x and y are as defined above and Z is hydroxy or halogen, with a polyalkyl alcohol of formula III under the esterification conditions described above. Compounds of formula IX wherein Z is hydroxy are described, for example, in U.S. Pat. Nos. 3,642,882; 4,946,926 and 3,763,210.

The resulting cyano or nitro aromatic ethers may then be reduced to the corresponding amino or aminomethyl compound using conventional hydrogenation conditions well known in the art to yield the polyalkyl esters of the substituted polyphenyl ethers of formula I. Hydrogenation of aromatic cyano and nitro groups are discussed in further detail in P. N. Rylander, *Catalytic Hydrogenation in Organic Synthesis*, Academic Press (1979).

Reductions can also be accomplished through the use of reducing metals in the presence of acids, such as hydrochloric acid. Typical reducing metals are zinc, iron, and tin; salts of these metals can also be used.

Typically, the amino or aminomethyl substituted polyphenyl ethers of the present invention are obtained by reduction of the corresponding cyano or nitro compound with hydrogen in the presence of a metallic catalyst such as palladium. This reduction is generally carried out at temperatures of about 20° C. to about 100° C., typically, about 20° C. to about 40° C., and hydrogen pressures of about atmospheric to about 200 psig, typically, about 20 to about 80 psig. The reaction time for reduction usually varies between about 5 minutes to about 24 hours. Substantially, inert liquid diluents and solvents, such as ethanol, cyclohexane, ethyl acetate, toluene, etc., can be used to facilitate the reaction. The substituted aromatic polyalkyl ethers can then be obtained by well-known techniques such as distillation, filtration, extraction, and so forth.

When synthesizing the polyalkyl esters of the substituted polyphenyl ethers of formula I having an amino group on the aromatic moiety (i.e., where A is an amino group), it is generally desirable to first prepare the corresponding nitro compound (i.e., where A is a nitro group) using the above-described synthetic procedures, and then to reduce the nitro group to an amino group using conventional procedures. Aromatic nitro groups may be reduced to amino groups using a number of procedures that are well known in the art. For example, aromatic nitro groups may be reduced under catalytic hydrogenation conditions; or by using a reducing metal, such as zinc, tin, iron, and the like, in the presence of an acid, such as dilute hydrochloric acid.

Generally, reduction of the nitro group by catalytic hydrogenation is preferred. Typically, this reaction is conducted using about 1 to about 4 atmospheres of hydrogen and a platinum or palladium catalyst, such as palladium on carbon. The reaction is typically carried out at a temperature of 0° C. to about 100° C. for about 1 to about 24 hours in an inert solvent, such as ethanol, ethyl acetate, and the like. Hydrogenation of aromatic nitro groups is discussed in further detail in, for example, P. N. Rylander, *Catalytic Hydrogenation in Organic Synthesis*, pp. 113–137, Academic Press (1979); and *Organic Synthesis, Collective Vol. I*, Second Edition, pp. 240–241, John Wiley & Sons, Inc. (1941); and references cited therein.

Fuel Compositions

The polyalkyl esters of the substituted polyphenyl ethers of the present invention are useful as additives in hydrocarbon fuels to prevent and control engine deposits, particularly intake valve deposits. Typically, the desired deposit control is achieved by operating an internal combustion engine with a fuel composition containing a polyalkyl ester of a substituted polyphenylether of the present invention. The proper concentration of additive necessary to achieve the desired level of deposit control varies depending upon the type of fuel employed, the type of engine, and the presence of other fuel additives.

In general, the concentration of the polyalkyl esters of the substituted polyphenyl ethers of this invention in hydrocarbon fuel will range from about 50 to about 2500 parts per million (ppm) by weight, preferably from about 75 to about 1000 ppm. When other deposit control additives are present, a lesser amount of the present additive may be used.

The polyalkyl esters of the substituted polyphenyl ethers of the present invention may also be formulated as a concentrate using an inert stable oleophilic (i.e., dissolves in gasoline) organic solvent boiling in the range of about 150° F. to about 400° F. (about 65° C. to about 205° C.). Preferably, an aliphatic or an aromatic hydrocarbon solvent is used, such as benzene, toluene, xylene, or higher-boiling aromatics or aromatic thinners. Aliphatic alcohols containing about 3 to about 8 carbon atoms, such as isopropanol, isobutylcarbinol, n-butanol, and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent.

In gasoline fuels, other fuel additives may be employed with the additives of the present invention, including, for example, oxygenates, such as t-butyl methyl ether, anti-knock agents, such as methylcyclopentadienyl manganese tricarbonyl, and other dispersants/detergents, such as hydrocarbyl amines, hydrocarbyl polyalkyl amines, or succinimides. Additionally, antioxidants, metal deactivators, and demulsifiers may be present.

In diesel fuels, other well-known additives can be employed, such as pour point depressants, flow improvers, cetane improvers, and the like.

A fuel-soluble, nonvolatile carrier fluid or oil may also be used with the polyalkyl esters of the substituted polyphenyl ethers of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Patent Application Nos. 356,726 and 382,159, published Mar. 7, 1990 and Aug. 16, 1990, respectively.

These carrier fluids are believed to act as a carrier for the fuel additives of the present invention and to assist in removing and retarding deposits. The carrier fluid may also exhibit synergistic deposit control properties when used in combination with a polyalkyl ester of a substituted polyphenylether of this invention.

The carrier fluids are typically employed in amounts ranging from about 100 to about 5000 ppm by weight of the hydrocarbon fuel, preferably from about 400 to about 3000 ppm of the fuel. Preferably, the ratio of carrier fluid to deposit control additive will range from about 0.5:1 to about 10:1, more preferably from about 1:1 to about 4:1, most preferably about 2:1.

When employed in a fuel concentrate, carrier fluids will generally be present in amounts ranging from about 20 to about 60 weight percent, preferably from about 30 to about 50 weight percent.

EXAMPLES

The following examples are presented to illustrate specific embodiments of the present invention and synthetic preparations thereof; and therefore these examples should not be interpreted as limitations upon the scope of this invention.

Example 1

Preparation of

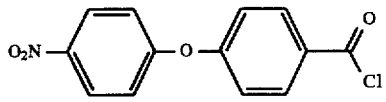

To a flask equipped with a magnetic stirrer and drying tube was added 4-(4'-nitrophenoxy)benzoic acid (10.0 grams, prepared essentially as described in Example 3 of U.S. Pat. No. 3,642,882), anhydrous dichloromethane (100 mL), and oxalyl chloride (8.4 mL). N,N-Dimethylformamide (one drop) was then added. The resulting mixture was stirred at room temperature for 16 hours and the solvent removed in vacuo to yield 10.7 grams of the desired acid chloride as a yellow solid.

Example 2

Preparation of

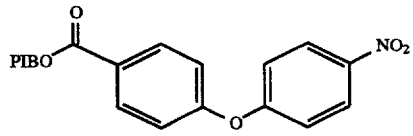

4-4'-Nitrophenoxy)benzoyl chloride (5.3 grams, prepared as in Example 1), polyisobutanol (18.2 grams, molecular weight average 984, prepared via hydroformylation of Amoco H-100 polyisobutene), 4-dimethylaminopyridine (2.5 grams) and anhydrous chloroform (100 mL) were combined. The resulting mixture was refluxed under nitrogen for 16 hours. The reaction was diluted with 300 mL of dichloromethane and was washed twice with one percent aqueous hydrochloric acid, twice with saturated aqueous sodium bicarbonate solution and once with brine. The organic layer was dried over anhydrous magnesium sulfate, filtered and the solvents removed in vacuo to yield 21.8 grams as an oil. The oil was chromatographed on silica gel eluting with hexane/ethyl acetate (90:10) to afford 12.8 grams of the desired product as a yellow oil. $^1$H NMR ($CDCl_3$) d 8.25 (AB quartet, 2H), 8.1 (AB quartet, 2H), 7.1 (AB quartet, 4H), 4.2–4.4 (m, 2H), 0.6–1.8 (m, 137H).

Example 3

Preparation of

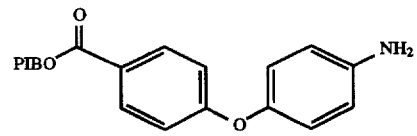

A solution of 9.8 grams of the product from Example 2 in 200 mL of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 8.6 grams as a yellow oil. $^1$H NMR ($CDCl_3$, $D_2O$) d 7.95 (AB quartet, 2H), 6.9 (AB quartet, 4H), 6.7 (AB quartet, 2H), 4.2–4.4 (m, 2H), 0.6–1.8 (m, 137H).

Example 4

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200° F.; vacuum of 12 in Hg, air-fuel ratio of 12, ignition spark timing of 400 BTC; engine speed is 1800 rpm; the crankcase oil is a commercial 30 W oil.

The amount of carbonaceous deposit in milligrams on the intake valves is reported for each of the test compounds in Table I.

TABLE I

| | Intake Valve Deposit Weight (in milligrams) | | |
|---|---|---|---|
| Sample[1] | Run 1 | Run 2 | Average |
| Base Fuel | 282.2 | 272.0 | 277.1 |
| Example 2 | 218.0 | 225.2 | 221.9 |
| Example 3 | 15.0 | 15.0 | 15.0 |

[1]At 150 parts per million actives (ppma).

The base fuel employed in the above single-cylinder engine tests was a regular octane unleaded gasoline containing no fuel detergent. The test compounds were admixed with the base fuel to give the concentrations indicated in the table.

The data in Table I illustrates the significant reduction in intake valve deposits provided by the polyalkyl esters of substituted polyphenylethers of the present invention (Examples 2 and 3) compared to the base fuel.

What is claimed is:

1. A compound of the formula:

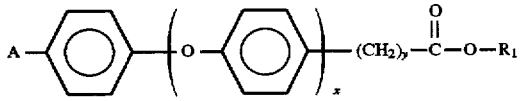

wherein

A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ is a polyalkyl group having an average molecular weight in the range of about 450 to about 5000;

x is an integer from about 1 to about 10 and y is an integer from 0 to about 10.

2. The compound according to claim 1, wherein A is amino or aminomethyl.

3. The compound according to claim 2, wherein A is amino.

4. The compound according to claim 1, wherein $R_1$ is a polyalkyl group having an average molecular weight in the range of about 500 to about 5000.

5. The compound according to claim 4, wherein $R_1$ is a polyalkyl group having an average molecular weight in the range of about 500 to about 3000.

6. The compound according to claim 5, wherein $R_1$ is a polyalkyl group having an average molecular weight in the range of about 500 to about 2000.

7. The compound according to claim 1, wherein x is an integer of about 1 and y is 0.

8. The compound according to claim 1, wherein $R_1$ is a polyalkyl group derived from polypropylene, polybutene, or polyalphaolefin oligomers of 1-octene or 1-decene.

9. The compound according to claim 8, wherein $R_1$ is derived from polyisobutene.

10. The compound according to claim 9, wherein the polyisobutene contains at least about 20% of a methylvinylidiene isomer.

11. A fuel composition comprising a major amount of hydrocarbons boiling in the gasoline or diesel range and an effective deposit-controlling amount of a compound of the formula:

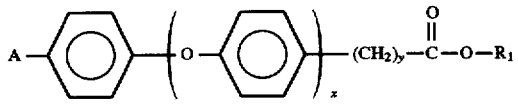

wherein

A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ is a polyalkyl group having an average molecular weight in the range of about 450 to about 5000;

x is an integer from about 1 to about 10 and y is an integer from 0 to about 10.

12. The fuel composition according to claim 11, wherein A is amino or aminomethyl.

13. The fuel composition according to claim 12, wherein A is amino.

14. The fuel composition according to claim 11, wherein $R_1$ is a polyalkyl group having an average molecular weight in the range of about 500 to about 5000.

15. The fuel composition according to claim 14, wherein $R_1$ is a polyalkyl group having an average molecular weight in the range of about 500 to about 3000.

16. The fuel composition according to claim 15, wherein $R_1$ is a polyalkyl group having an average molecular weight in the range of about 500 to about 2000.

17. The fuel composition according to claim 11, wherein x is an integer of about 1 and y is 0.

18. The fuel composition according to claim 11, wherein $R_1$ is a polyalkyl group derived from polypropylene, polybutene, or polyalphaolefin oligomers of 1-octene or 1-decene.

19. The fuel composition according to claim 18, wherein $R_1$ is derived from polyisobutene.

20. The fuel composition according to claim 19, wherein the polyisobutene contains at least about 20% of a methylvinylidene isomer.

21. The fuel composition according to claim 11, wherein said composition contains about 50 to about 2500 parts per million by weight of said compound.

22. The fuel composition according to claim 21, wherein said composition further contains about 100 to about 5000 parts per million by weight of a fuel soluble, non-volatile carrier fluid.

23. A method for reducing engine deposits in an internal combustion engine comprising operating an internal combustion engine with the fuel composition of claim 11.

24. A fuel concentrate comprising an inert stable oleophilic organic solvent boiling in the range of from about 150° F. to about 400° F. and from about 10 to about 70 weight percent of a compound of the formula:

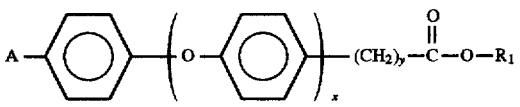

wherein

A is amino, aminomethyl, cyano, nitro, N-alkylamino or N-alkylaminomethyl wherein the alkyl group contains about 1 to about 6 carbon atoms, or N,N-dialkylamino or N,N-dialkylaminomethyl wherein each alkyl group independently contains about 1 to about 6 carbon atoms;

$R_1$ is a polyalkyl group having an average molecular weight in the range of about 450 to about 5000;

x is an integer from about 1 to about 10 and y is an integer from 0 to about 10.

25. The fuel concentrate according to claim 24, wherein $R_1$ is a polyalkyl group having an average molecular weight in the range of about 500 to about 5000.

26. The fuel concentrate according to claim 25, wherein $R_1$ is a polyalkyl group having an average molecular weight in the range of about 500 to about 3000.

27. A fuel concentrate according to claim 26, wherein $R_1$ is a polyalkyl group having an average molecular weight in the range of about 500 to about 2000.

28. The fuel concentrate according to claim 24, wherein $R_1$ is a polyalkyl group derived from polypropylene, polybutene, or polyalphaolefin oligomers of 1-octene or 1-decene.

29. The fuel concentrate according to claim 28, wherein $R_1$ is derived from polyisobutene.

30. The fuel concentrate according to claim 29, wherein the polyisobutene contains at least about 20% of a methylvinylidene isomer.

31. The fuel concentrate according to claim 24, wherein A is amino or aminomethyl.

32. The fuel concentrate according to claim 25, wherein A is amino.

33. The fuel concentrate according to claim 24, wherein x is an integer of about 1 and y is 0.

* * * * *